US007333398B2

(12) United States Patent
Thompson et al.

(10) Patent No.: US 7,333,398 B2
(45) Date of Patent: Feb. 19, 2008

(54) DEVICE FOR THE INDICATION OF ELAPSED TIME

(75) Inventors: James S. Thompson, San Francisco, CA (US); Robert Sloan, Sunnyvale, CA (US)

(73) Assignee: Cube Root, Inc., San Francisco, CA (US)

( * ) Notice: Subject to any disclaimer, the term of this patent is extended or adjusted under 35 U.S.C. 154(b) by 198 days.

(21) Appl. No.: 11/340,386

(22) Filed: Jan. 26, 2006

(65) Prior Publication Data

US 2007/0171770 A1 Jul. 26, 2007

(51) Int. Cl.
*G04C 19/00* (2006.01)

(52) U.S. Cl. ..... 368/82; 368/223

(58) Field of Classification Search ..... 368/82
See application file for complete search history.

(56) References Cited

U.S. PATENT DOCUMENTS

| | | | | |
|---|---|---|---|---|
| 3,744,235 | A * | 7/1973 | Kratomi | 368/79 |
| 3,750,384 | A | 8/1973 | Miller et al. | |
| 4,041,692 | A | 8/1977 | Marshino | |
| 4,254,487 | A | 3/1981 | Lee | |
| 4,370,068 | A | 1/1983 | Han | |
| 4,459,034 | A | 7/1984 | Kawabata et al. | |
| 4,803,672 | A | 2/1989 | Zang | |
| 4,872,150 | A * | 10/1989 | Norman | 368/223 |
| 4,920,524 | A | 4/1990 | Kotob | |
| 5,199,009 | A | 3/1993 | Svast | |
| 5,896,348 | A | 4/1999 | Lyon | |
| 6,256,265 | B1 * | 7/2001 | Sepulveda | 368/82 |
| 2002/0031051 | A1 * | 3/2002 | Emami | 368/76 |

OTHER PUBLICATIONS

Product brochure for Chron-Art, Inc., "TimeCapsule", dated approximately Nov. 1996.
"G-Version" by twelve 5-9, found at http://www.tokyoflash.com/viewwatch94W1industrial-design-watches.html.

* cited by examiner

*Primary Examiner*—P. Austin Bradley
*Assistant Examiner*—Thanh S. Phan
(74) *Attorney, Agent, or Firm*—Jonathan A. Small

(57) ABSTRACT

A device for indicating elapsed time by way of the state of indicators is disclosed, such indicators being arranged in at least four groups such that the first two groups taken together indicate elapsed hours and the second two groups taken together indicate elapsed minutes. The indicators are switchable between a first and second state, such as illuminated or not illuminated. The number of indicators in a first state, such as illuminated, indicate the value of a digit.

15 Claims, 4 Drawing Sheets

DEVICE FOR THE INDICATION OF ELAPSED TIME

BACKGROUND OF THE INVENTION

1. Field of the Invention

The present invention is related to devices for timekeeping, and more particularly to clocks and the like which convey time of day information by symbolic indication rather than position of rotating hands.

2. Description of the Prior Art

There exists today an extremely wide variety of devices for keeping time. Such devices may measure the quantity of time that has elapsed from the occurrence of an event, such as the start of a race, or measure the time that has elapsed from some local reference such as midnight or noon for a local time zone (for example, 2:35 p.m. indicates two hours and 35 minutes after 12:00 noon for that time zone). The measure of elapsed time may be indicated in a variety of ways. For example, elapsed time may be indicated by position of a rotating long pointer (hand) to indicate elapsed minutes and a rotating short pointer (hand) to indicate elapsed hours (i.e., traditional mechanical clocks). The face of such clocks are commonly divided up circumferentially into 12 equally-spaced positions, one for each elapsed hour, and the circumferential space between each hour location divided into 5 equally-spaced positions, one for each elapsed minute; There are myriad variations to this design, motivated by reducing cost and complexity, aesthetics, available technology, ease of use, improved accuracy, whimsy, etc.

Of relevance here are designs in which the physical hands indicating hours and minutes are replaced with alternative methods of indicating elapsed time. Perhaps the most prevalent design alternative to the traditional hand-design for clocks are what are commonly known as "digital clocks", those in which time is indicated by the display of the numerical digits for hours and minutes. However, there are many other hand-free designs known, such as those simulating hands, as disclosed in U.S. Pat. No. 4,254,489, and those indicating elapsed time by displaying a series of indicia, such as dots or line segments, not arranged in hand-like patterns. For example, U.S. Pat. No. 4,041,692 provides three concentric rings of light emitting diodes (LEDs), with one ring of 60 LEDs indicating elapsed seconds, one ring of 60 LEDs radially inward from the first indicating elapsed minutes, and one radially inner-most ring of 12 LEDs indicating elapsed hours. The large number of indicators renders this design expensive to manufacture, relatively difficult to read, and prone to failure. Perhaps motivated by these challenges, another example, disclosed in U.S. Pat. No. 4,459,034, reduces the total number of required LEDs by providing a main display area with a reduced number of minute indicators, each indicating 2.5 elapsed minutes, and an auxiliary display portion for indicating elapsed individual elapsed minutes. A variation on this design is disclosed by U.S. Pat. No. 4,370,068, in which minutes are indicated by a first group of indicators in increments of 5 minutes, and by a second group of indicators in increments of 1 minute. The indicators in each of these examples are arranged in a generally circular pattern, employing the familiarity and experience users have with traditional hand-based based clocks.

Another set of devices are designed to forego this familiar circular design and any other similarity to traditional clocks. Illuminated indicia are most often used to provide a count, in one form or another, of elapsed hours, minutes, and seconds. Elapsed time is often displayed in a code or unique sequence of indicators. For example, U.S. Pat. No. 3,750,384 displays time in three rows of indicators using a binary code system. For example, minute indicators are provided for 1, 2, 4, 8, 16, and 32 minutes, and actual minutes elapsed are represented by combinations of the illumination of these indicators. Another example is U.S. Pat. No. 5,896,348, which discloses three groups of indicators, the first group consisting of 12 indicators, one for each elapsed hour, the second consisting of 5 indicators, one for each 10 minutes elapsed, and the third group consisting of 9 indicators, one for each elapsed minute. Hours are read by counting the number of indicators illuminated in the first group. Minutes are read by multiplying the number of indicators in the second group by 10, then adding the number of indicators illuminated in the third group.

While each of the aforementioned devices for indicating elapsed time meet a particular need or interest, some have shortcomings which motivate the search for new and improved designs. Whether for practical or aesthetic reasons, curiosity, or a combination of each of these, there is perpetually a need and interest for novel ways of indicating time. The present invention, described in detail below, addresses this need and interest.

SUMMARY OF THE INVENTION

Accordingly, the present invention concerns a novel design of a device for indicating elapsed time by way of the state of indicators, such indicators being arranged in at least four groups such that the first two groups taken together indicate elapsed hours and the second two groups taken together indicate elapsed minutes. The indicators are switchable between a first and second state, such as illuminated or not illuminated. The number of indicators in a first state, such as illuminated, indicate the value of a digit.

According to one aspect of the invention in which four groups of indicators are employed, each group is functionally similar to a digit found on a standard digital clock. Two groups of indicators cooperatively serve to indicate an elapsed number of hours or minutes. For example, if a single indicator in the first group of hour indicators is in a first state, and two indicators in the second group of hour indicators are also in the first state, then the elapsed number of hours is indicated as "1 " "2" or 12. It will be appreciated that the minimum number of indicators in the first group of hour indicators is 1 for a 12-hour display and 2 for a 24-hour display. The minimum number of indicators in the second group of hour indicators is nine for either 12- or 24-hour display. Likewise, the minimum number of indicators in the first group of minute indicators is 5, and the minimum number of indicators in the second group of minute indicators is 9, each for either a 12- or 24-hour display.

According to another aspect of the invention, indicators for indicating elapsed seconds may also be provided. Such an arrangement requires two additional groups of indicators, with the first group of these seconds indicators comprising a minimum of 5 indicators, and the second group of seconds indicators comprising a minimum of 9 indicators.

According to still another aspect of the present invention, the first state of each group of indicators may be illumination of the indicators in a selected color. The colors for the indicators within each group may be the same or may be different. Likewise the color of each group of indicators may be the same as or different from the color of each of the other groups. For example, when in the first state, the groups of indicators for hours may be a first color, and the groups of indicators for the minutes be a second color different than the first. Alternatively, the color of illumination of indicators in a first state may be randomly assigned by group. As a further alternative, indicators for a group being a first color may indicate a first state, and those of that group being a second color may indicate a second state.

According to yet another aspect of the present invention, periodically the state of the indicators in each group may change while the total number of indicators illuminated in that group remains constant. An interest-capturing changing pattern of indicators may thus be provided while not affecting the indication of elapsed time.

The groups of indicators according to the present invention may be arranged in one of a variety of patterns. For example, indicators may be grouped in rectangular regions spaced apart from one another so a user can visually differentiate the groupings of indicators. Alternatively, the indicators may be grouped in circular, triangular, columnar or other geometric or randomly-shaped regions, again each region spaced apart from one another so a user can visually differentiate the groupings of indicators.

While the device for indication of elapsed time according to the present invention lends itself to a variety of configurations, its arrangement and design overcome a number of the limitations of prior timepieces. For example, the number indicators required is reduced, both overall and within any grouping of indicators, as compared to similar prior designs. Lower cost of manufacture, improved reliability (fewer devices to fail), and easier reading of elapsed time are key benefits of this improvement. The indicators may be grouped in any of a wide variety of patterns to permit ease of viewing and allow for aesthetic design. Finally there is a correspondence between a familiar digital clock (in this case a digital clock) and the scheme for indicating elapsed time, thus providing a context for use without requiring that users learn a new paradigm or code for deciphering the indication of elapsed time. While these are many of the key features and advantages of the present invention, a more complete understanding of its design and operation will be had with reference to the following detailed description and referenced figures, and the array of features and advantages of the present invention will be more fully appreciated when considered in terms of the claims provided herein below.

BRIEF DESCRIPTION OF THE DRAWINGS

In the following Detailed Description of the Invention reference is made to the appended drawings in which like reference numerals denote like elements between the various drawings. The drawings are not drawn to scale. These drawings comprise.

DETAILED DESCRIPTION OF THE INVENTION

Figure 1:
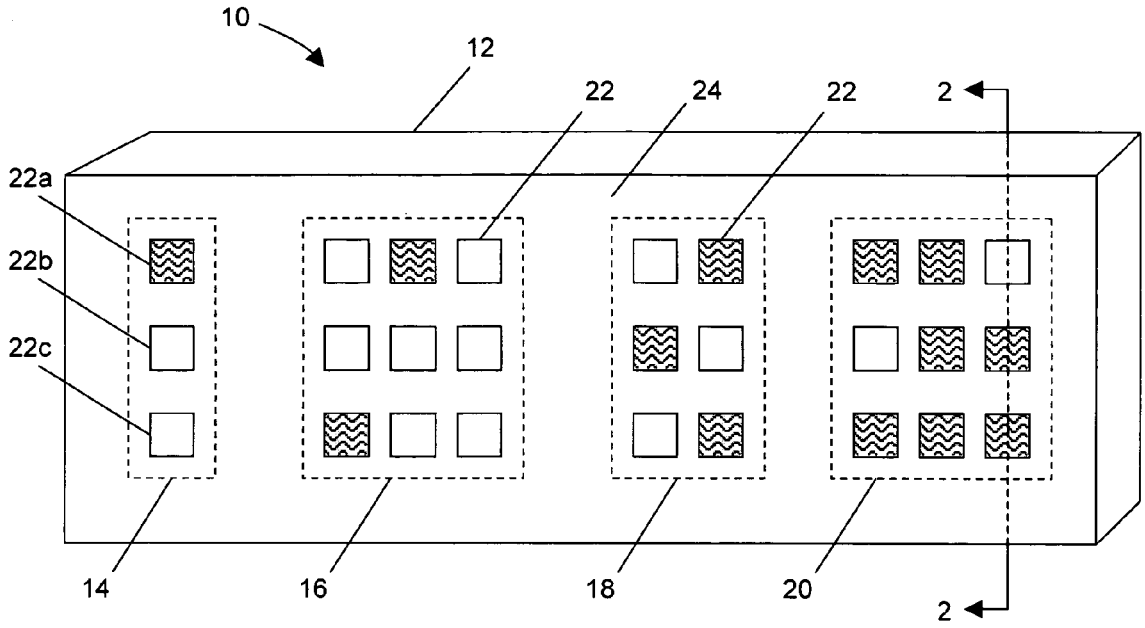
FIG. 1, which is a perspective view of a device for indicating elapsed time according to an embodiment of the present invention.

With reference to FIG. 1, there is shown therein an embodiment of a device 10 for indication of elapsed time according to the present invention. Device 10 consists of an enclosure 12 having a face 24 on which are disposed a plurality of groups, e.g., groups 14, 16, 18, 20, of indicators 22. Disposed within enclosure 12, but not shown in FIG. 1, may be circuitry, interconnections between circuitry and indicators, interconnections between circuitry and a power supply, and optionally, alarm functionality, such as a speaker, power supply such as a battery, power transformer, etc., Disposed on the back or other surface of device 10, and interconnected to the circuitry disposed therein, are mechanisms for setting, starting and stopping, and controlling functions of the device 10.

In the embodiment shown in FIG. 1, each group 14, 16, 18, 20 is provided with a number of indicators 22 selected according to the function of that group and for aesthetics. For example, first group 14 consists of 3 indicators 22. Second group 16 consists of 9 indicators 22. Third group 18 consists of 6 indicators 22. Fourth group 20 consists of 9 indicators. FIG. 1 shows the indicators in each group arranged in rectangular patterns, although other arrangements of the groups, and numbers of indicators in each are clearly contemplated by this disclosure.

Each indicator 22 has two possible states. The first state may be, for example, illuminated, and the second state may be not illuminated. Alternatively, a first state may be illuminated a first color, and the second state may be illuminated a second color different than the first. Other alternatives for first and second states include differing patterns within each indicator or within a group of indicators, indicator strobe or blink rate, indicator sizes (or perceived size) or other visible variable attributes. Each group 14, 16, 18, 20 may posses a unique attribute (e.g., color of indicator) in either the first or second state. For example, in a first state in which certain indicators are illuminated, those illuminated indicators of group 14 may all be red, those illuminated indicators of group 16 may all be green, those illuminated indicators of group 18 may all be blue, and those illuminated indicators of group 20 may all be yellow. Of course this particular color selection is arbitrary, but represents the broader idea of differing colors from one group to the next. Such an arrangement assists in the visual separation of the groups from one another, and aids a user in reading elapsed time. Optionally, within a group, the individual indicators may all posses different attributes or the attributes may change randomly or pursuant to a predetermined pattern when in a first or second state, as the design of the device warrants.

First group of indicators 14 is used to indicated the first digit in the elapsed number of hours. For example, in FIG. 1 group 14 is shown with indicators is two different states. Indicator 22*a* is, for example, illuminated (and shown shaded in FIG. 1), while indicators 22*b* and 22*c* are not illuminated (and shown with no shading in FIG. 1). According to the teachings of the present invention, the number of indicators 22 in the first state in first group 14 represents the first of two digits in the number of elapsed hours. Thus, the first digit in elapsed hours represented in FIG. 1 is "1". Similarly, the number of indicators 22 in second group 16 in the first state represents the second of the two digits in the number of elapsed hours. Thus, the second digit in elapsed hours represented in FIG. 1 is "2". Accordingly, the digits of the elapsed hour depicted in FIG. 1 are "1" and "2", thus the elapsed number of hours is twelve (similarly, for example, a "0" and "3" represent three elapsed hours, a "0" and a "9" represent nine elapsed hours, etc.) In the case of a 24-hour clock, the number of elapsed hours are between zero and twenty three, thus a "1" and "7" indicate seventeen elapsed hours, a "2" and "3" indicate twenty three elapsed hours, etc. Finally, in the case of a count-up or count-down timer for timing an event or the like, the number of elapsed hours may not be limited other than by the size of device 10, the indicators 22, the target application, etc., and may for example have first and second groups each with nine indicators, allowing for elapsed times read as "4" and "6", or forty six elapsed hours, "8" and "1" as 81 elapsed hours, etc.

Likewise, the number of indicators 22 in the first state in third group 18 represents the first of two digits in the number of elapsed minutes. Thus, the first digit of the elapsed minutes represented in FIG. 1 is "3". Similarly, the number of indicators 22 in fourth group 20 in the first state represents the second of the two digits in the number of elapsed minutes. Thus, the second digit of the elapsed minutes represented in FIG. 1 is "7". Accordingly, the digits representing the elapsed minutes depicted in FIG. 1 are "3" and "7" and thus the elapsed number of minutes is "37". The time of day indicated in FIG. 1 is therefore 12:37.

One variation of the arrangement shown in FIG. 1 is to add additional groups of indicators (not shown) to indicate elapsed seconds—a fifth group (e.g., of at least 5 indicators) for a first digit in seconds and a sixth group (e.g., of at least 9 indicators) for a second digit in seconds. Still another variation is to provide an indicator (not shown) for antemeridian (a.m.) and post-meridian (p.m.)

While certain indicators 22 are shown in a first state (i.e., shaded) in FIG. 1, their selection for the purposes of this example was purely random. Any set of indicators within each group may be in the first state to indicate elapsed hours or minutes (or seconds). Indeed, which particular set of indicators 22 in the first state may change periodically, while the number of indicators in the first state in the group remains constant (until the minutes or hours increment) for visual effect. The change may be random or follow a predetermined pattern. The time interval between pattern changes may also be random or preset. And the decision to change patterns, change them randomly or according to a preset pattern, and how often to change them may be made available to the user by means of a selection device such as a switch or other mechanism (not shown in FIG. 1), for example located at the back of enclosure 12.

It should be noted that three indicators are provided in first group 14. However, if elapsed time is indicated in units of 12 hours, only one of the indicators 22 are required, and if elapsed time is indicated in units of 24 hours (so-called "military time") only two of the indicators 22 are required. Likewise, six indicators are provided in third group 18. However, the most that are actually required to indicate the maximum number of elapsed minutes (i.e., 59), is five. The extra indicators 22 may be provided for aesthetic reasons, to help balance the look of the face 24 of device 10. Furthermore, in the mode of operation wherein the indicators periodically change patterns, the additional indicators provided added visual interest to the dynamically changing display of elapsed time.

Figure 2:
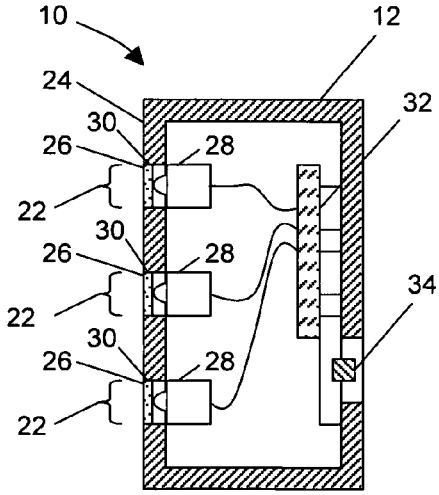
FIG. 2 is a cut-away cross sectional view of the device illustrated in FIG. 1.

With reference now to FIG. 2, there is shown therein a cut-away side view of device 10. Shown in FIG. 2 are a number of indicators 22, secured at openings 26 in face 24 of enclosure 12. According to one embodiment, indicators 22 comprise an appropriately sized light emitting device 28, such as light emitting diodes (LEDs), organic LEDs (OLEDs), compact fluorescent or similar gas discharge lamp, and a lens 30, which may take the form of a diffuser, color filter, patterned template, stencil, etc., or a combination thereof, for providing a desired light pattern, color or intensity from each individual indicator 22. According to one embodiment, each indicator 22 may emit light which is filtered by lens 30 to a selected color which is transmitted to a viewer, and the aforementioned color differences between groupings of indicators is provided by the selection of lenses 30 for each indicator. According to another embodiment, lenses 30 may be colored, patterned, etc., so that the differences between the first state and the second state are at least in part provided by the lenses.

Each indicator 22 is interconnected to a control circuit 32, for example an integrated circuit controller, discrete circuitry controller on a printed circuit board, etc. One or more switches 34 are also provided in the rear of enclosure 12, for setting time, display options, etc., the operation of which is described further below.

Figure 3:
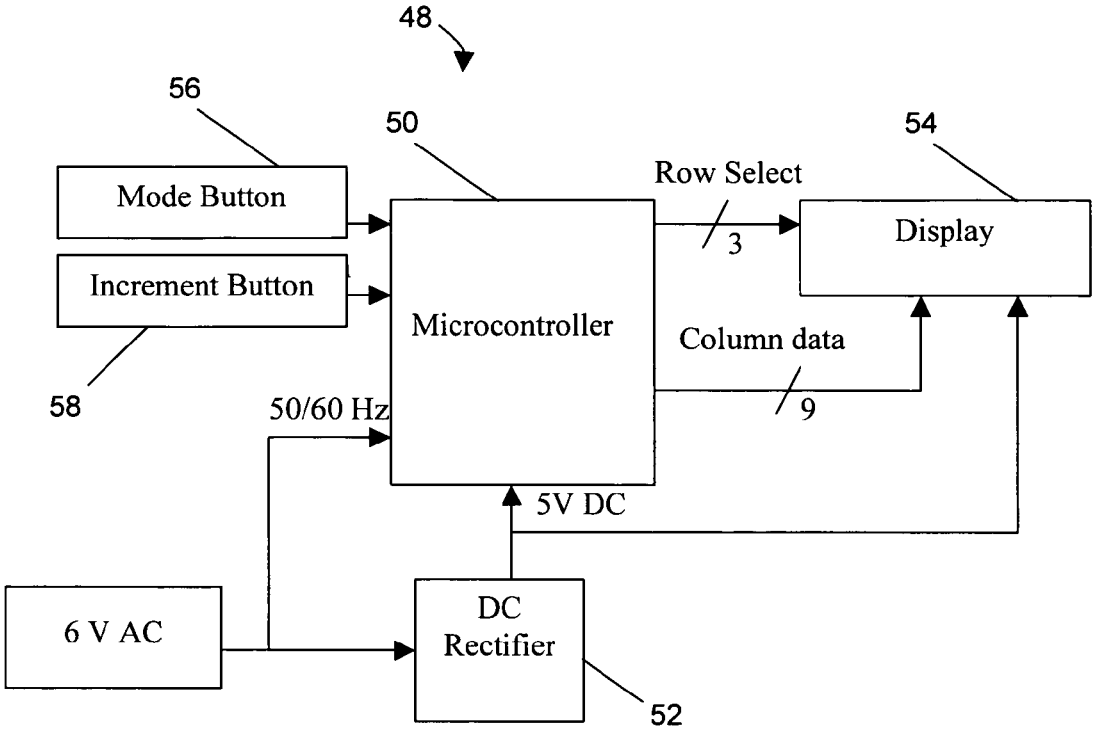
FIG. 3 is a schematic of a circuit which illustrates the basic components and interconnection of an exemplary embodiment of the present invention.

FIG. 3 is a schematic of a circuit 48 which illustrates the basic components and interconnection of an exemplary embodiment of the present invention. Microcontroller 50 controls the operation of the indicators 22, and responds to various user controls for setting the time, and controlling other features of the device 10. According to one embodiment, microcontroller 50 may be an 8-bit flash microcontroller such as model PIC16F628 from Microchip Technology, Inc. (Chandler, Ariz.). In the case of AC operation, microcontroller 50 operates on a supply of 5 volts DC provided by rectifier 52. A clock signal is obtained from the AC source supplying rectifier 52, which operates at either 50 or 60 Hz, depending on the location of use of device 10 (typically, 60 Hz in North America, and 50 Hz elsewhere). The output of rectifier 52 may also be used to provide power to a display device 54 comprising an array of light sources forming indicators 22. Microcontroller 50 drives display 54 with row and column data, which update the display in a raster fashion at a rate above the visual acuity of the viewer. Time set and other display control instructions are provided to microcontroller 50 by mode button 56 and increment button 58.

In the event of DC operation, timing (clocking) functionality may be provided by microcontroller 50 or by another oscillator or similar component (not shown) provided in circuit 48. The voltage provide will be coordinated with the voltage requirements of the microcontroller, display, and other elements forming circuit 48, as will be understood in the art.

Figure 4:
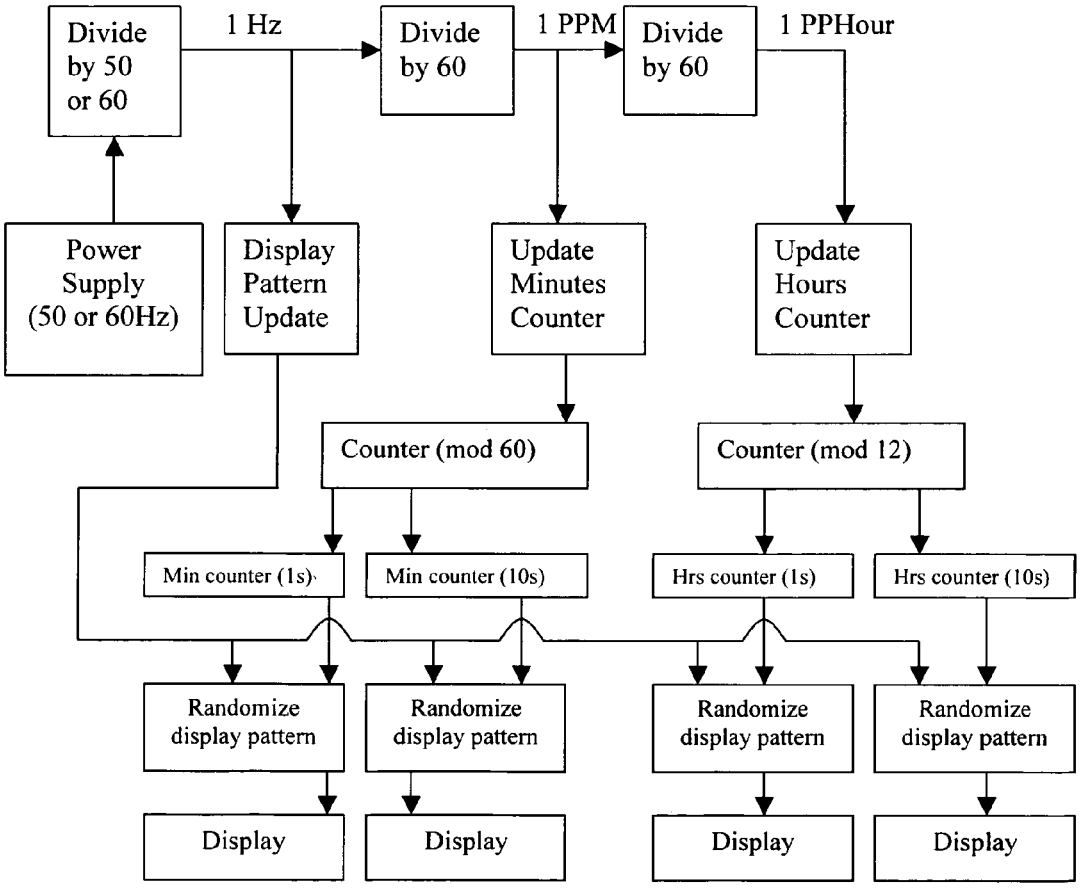
FIG. 4 is a functional diagram for the various components of the circuit illustrated in FIG. 3.

FIG. 4 is a functional diagram for the various components of circuit 48 illustrated in FIG. 3. As illustrated in the timing diagram of FIG. 4, the rate at which the display pattern is modified may be varied in terms of 1 (or more) second per refresh based on the division of the frequency of the AC source by 60 (or 50, if using 50 Hz AC), to get 1/sec. Updating of the minutes counter is based on the further division by 60 to get 1/min., and updating of the hours counter is based on the further division by 60 to get 1/hr. Once updated, the display positions for the specific indicators can be randomized if desired.

Figure 5:
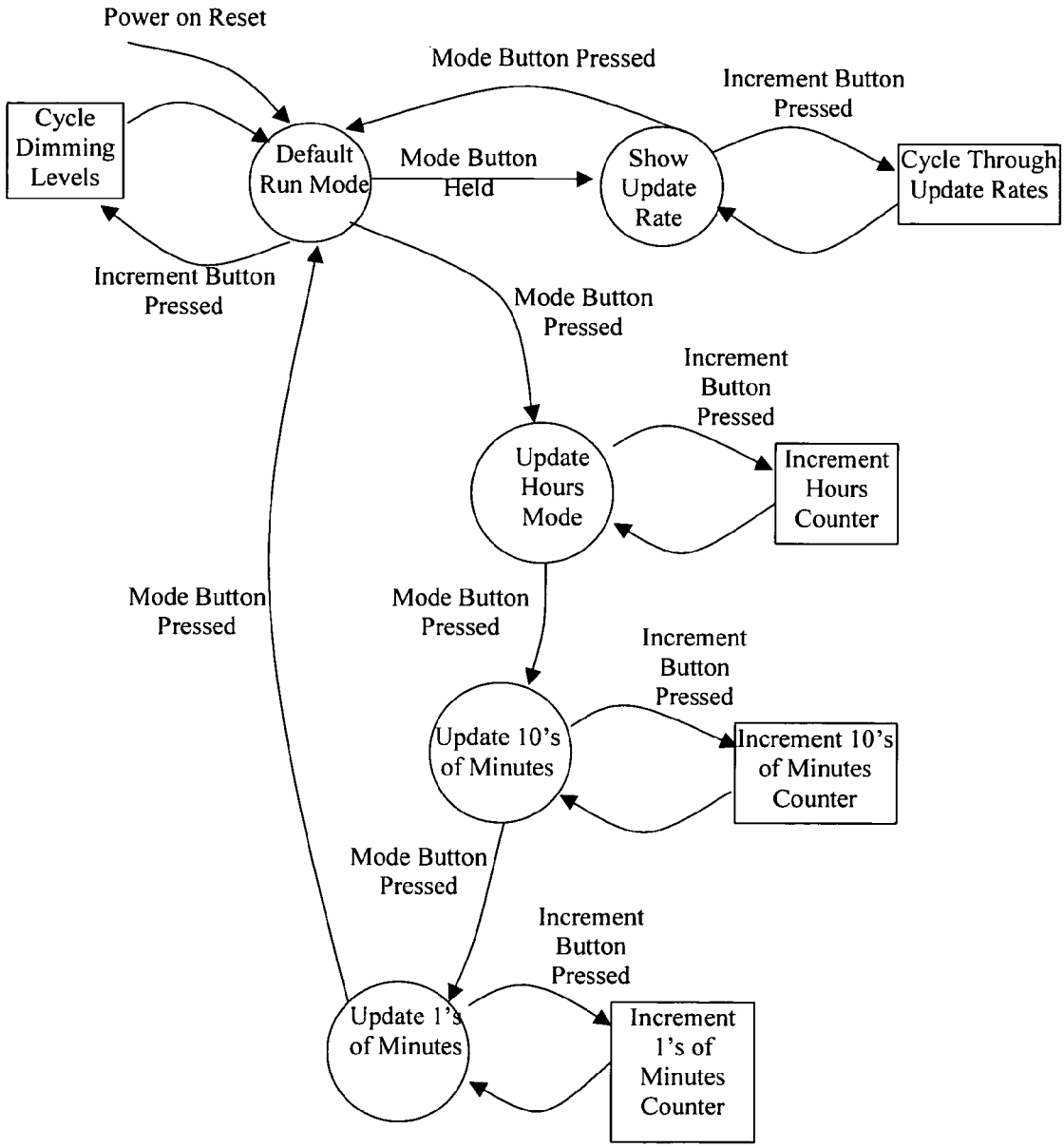
FIG. 5 is a state diagram, indicating the use of a two-button control system according to an exemplary embodiment of the present invention.

FIG. 5 is a state diagram, indicating the use of a two-button control system according to one embodiment of the present invention. The mode button (56 as shown in FIG. 3) is used primarily for setting the time. It selects the digit to be set. In the default run mode, the pattern of indicators stops changing and all indicators of the two hours indicator groups flash and the number of indicators in those fields return to their original states. The increment button (58 in FIG. 3) now allows the user to increment the number of indicators which are in a desired first state (e.g., on) for the hours indicator groups. When the mode button 56 is pressed again the 10's of minutes indicator group flashes and then returns to its previous state. The increment button now allows the user to increment the number of indicators which are in the desired first state in the 10's of minutes indicator groups. When the mode button 56 is pressed again the 1's of minutes indicator group flashes and then returns to its previous state. The increment button now allows the user to increment the number of indicators which are in the desired first state in the 1's of minutes indicator groups. Pressing the mode button 56 a final time zeros an internal seconds counter and returns the clock to its default run mode.

As previously mentioned, the pattern of indicators in a first state for indicating elapsed time may be static, and change only as time elapses, or may vary for visual interest within the intervals during which indicated time does not change. The user may be provided control over this feature, including the rate at which the display. pattern changes, using the aforementioned mode button 56. If the mode button 56 is held down for longer than a distinct period of time, such as at least 2 seconds, in the default run mode, the mode changes to setting the pattern change or update rate. Increment button 58 then provides selection between, for example, 1 second, 4 second, and 1 minute update rates.

Other aspects of control over the display may also be provided. For example, increment button 58 may be programmed such that if is activated without an associated prior activation of mode button 56 (i.e., in the default run mode), the display may be made to cycle through 4 brightness levels. Additional buttons or controls may be provided (not shown) to start, stop, and reset the device when employed as a count-up or count-down timer, to set and activate/deactivate an alarm mode, etc.

While a plurality of preferred exemplary embodiments have been presented in the foregoing detailed description, it should be understood that a vast number of variations exist, and these preferred exemplary embodiments are merely representative examples, and are not intended to limit the scope, applicability or configuration of the invention in any way. For example, while the display of the elapsed time is provided on the face of the device described, such a display could just as easily be projected by the device onto a wall, ceiling or other surface by substituting projecting lenses in place of the diffusers described above. Therefore, the foregoing detailed description provides those of ordinary skill in the art with a convenient guide for implementation of the invention, and contemplates that various changes in the functions and arrangements of the described embodiments may be made without departing from the spirit and scope of the invention more particularly defined by the claims thereto.

What is claimed is:

1. A device for indicating elapsed time by way of the state of indicators, such indicators being arranged in a plurality of separate groups, each indicator having a first indication state and a second indication state, comprising:

a first group of indicators for indicating a first hours digit in the indication of elapsed hours by the count of the indicators in said first indication state; wherein said count is a number representing the value of the first hours digit of said elapsed hours;

a second group of indicators for indicating a second hours digit in the indication of elapsed hours by the count of the indicators in said first indication state; wherein said count is a number representing the value of the second hours digit of said elapsed hour;

a third group of indicators for indicating a first minutes digit in the indication of elapsed minutes by the count of the indicators in said first indication state; wherein said count is a number representing the value of the first minutes digit of said elapsed minutes;

a fourth group of indicators for indicating a second minutes digit in the indication of elapsed minutes by the count of the indicators in said first indication state; wherein said count is a number representing the value of the second minutes digit of said elapsed minutes; and the indication of elapsed hours requiring both the first hours digit and the second hours digit, and the indication of elapsed minutes requiring both the first minutes digit and the second minutes digit, such that the combination of the first hours digit and the second hours digit together with the first minutes digit and the second minutes digit provides an indication of total elapsed time in hours and minutes.

2. The device of claim 1, wherein said first hours digit represents elapsed hours in multiples of 10, and said second hours digit represents elapsed hours in multiples of one.

3. The device of claim 1, wherein said first minutes digit represents elapsed minutes in multiples of 10, and second minutes digit represents elapsed minutes in multiples of one.

4. The device of claim 1, further comprising:

a fifth group of indicators for indicating a first seconds digit in the indication of elapsed seconds by the count of the indicators in said first indication state; wherein said count is a number representing the value of the first seconds digit of said elapsed seconds;

a sixth group of indicators for indicating a second seconds digit in the indication of elapsed seconds by the count of the indicators in said first indication state; wherein said count is a number representing the value of the second seconds digit of said elapsed seconds;

whereby the combination of the first hours digit and the second hours digit, the first minutes digit and the second minutes digit, and the first seconds digit and the second seconds digit provide an indication of total elapsed time in hours, minutes, and seconds.

5. The device of claim 1, wherein in said first indication state an indicator is illuminated, and wherein in said second indication state the indicator is not illuminated.

6. The device of claim 1, wherein in said first indication state an indicator is illuminated a first color, and wherein in said second indication state the indicator is illuminated a second color different than the first color.

7. The device of claim 1, wherein each said indicator within a group is separated from adjacent indicators within that group by a first distance, and further wherein each said group of indicators is separated from adjacent groups of indicators by a second distance greater than the first distance in order to highlight the separateness of each group.

8. The device of claim 1, wherein in said first indication state each indicator is illuminated a color, the color of all indicators in said first indication state in a group being the same and different from the color of all indicators in said first indication state outside of said group, in order to highlight the separateness of each group.

9. The device of claim 1, wherein the indicators in each group in said first indication state form a pattern, the number of indicators in said first indication state in said group changing on a first periodic basis according to a change in the elapsed time, the pattern of indicators in said first indication state changing on a second periodic basis which is shorter in time than said first periodic basis.

10. The device of claim 9, wherein a user may select the second periodic basis.

11. The device of claim 1, wherein in said first indication state an indicator is illuminated, and further comprising means for adjusting the brightness of illumination of the indicator in said first indication state.

12. The device of claim 1, wherein the elapsed time represents the local time of day.

13. The device of claim 1, wherein the elapsed time represents a measure of the time elapsed since the occurrence of a selected event, the device further comprising a mechanism to initiate the measure of elapsed time.

14. The device of claim 1, wherein the elapsed time represents a measure of the time to elapse before the occurrence of a selected event.

15. A device for indicating elapsed time by way of the state of indicators, such indicators being arranged in four separate and distinct groups, each indicator having a first indication state in which it is illuminated and a second indication state in which it is not illuminated, comprising:

a first group of indicators for indicating elapsed hours in multiples of 10 hours by the count of the indicators in said first group in said first indication state; wherein said count is a number representing the value of the first group of said elapsed hours;

a second group of indicators for indicating elapsed hours in multiples of one, up to nine, by the count of the indicators in said second group in said first indication state; wherein said count is a number representing the value of the second group of said elapsed hours;

a third group of indicators for indicating elapsed minutes in multiples of 10 minutes by the count of the indicators in said third group in said first indication state; wherein said count is a number representing the value of the third group of said elapsed minutes;

a fourth group of indicators for indicating elapsed minutes in multiples of one, up to nine, by the count of the indicators in said fourth group in said first indication state; wherein said count is a number representing the value of the fourth group of said elapsed minutes;

whereby elapsed time in hours and minutes are indicated by the combination, in order, of the first through fourth groups of indicators; wherein each said indicator within a group is separated from adjacent indicators within that group by a first distance, and further wherein each said group of indicators is separated from adjacent groups of indicators by a second distance greater than the first distance in order to highlight the separateness of each group; and the indicators in each group in said first indication state form a pattern, the number of indicators in said first indication state in said group changing on a first periodic basis according to a change in the elapsed time, the pattern of indicators in said first indication state changing on a second periodic basis which is shorter in time than said first periodic basis.

* * * * *